United States Patent [19]

Lindemann

[11] Patent Number: 4,935,999

[45] Date of Patent: Jun. 26, 1990

[54] APPARATUS FOR DETECTING TIGHT ENDS IN A SHEET OF YARNS

[75] Inventor: Howard C. Lindemann, Huntington, N.Y.

[73] Assignee: Lindly & Company, Inc., Mineola, N.Y.

[21] Appl. No.: 428,407

[22] Filed: Oct. 30, 1989

Related U.S. Application Data

[63] Continuation-in-part of Ser. No. 292,546, Dec. 30, 1988, abandoned.

[51] Int. Cl.[5] ..... B65H 63/00; D02H 13/12; F26B 13/12

[52] U.S. Cl. ..... 28/187; 200/61.18

[58] Field of Search ..... 28/186, 187; 242/36; 200/61.18

[56] References Cited

U.S. PATENT DOCUMENTS

| | | | |
|---|---|---|---|
| 3,429,146 | 2/1969 | Cvach | 200/61.18 |
| 4,571,582 | 2/1986 | Walter | 28/187 X |

FOREIGN PATENT DOCUMENTS

| | | | |
|---|---|---|---|
| 879574 | 12/1957 | United Kingdom | 28/187 |
| 1133877 | 8/1966 | United Kingdom | 28/187 |

*Primary Examiner*—Werner H. Schroeder
*Assistant Examiner*—Bradley K. DeSandro
*Attorney, Agent, or Firm*—Robert E. Burns; Emmanuel J. Lobato

[57] ABSTRACT

Apparatus for detecting tight ends in a sheet of yarns of an associated yarn processing machine comprises an elongate channel extending transversely below the yarn sheet and having an upper open side. A multiplicity of sensing fingers having upwardly bowed central portions and projecting end portions are retained in the open side of the channel by flanges engaging the end portions of the fingers. A resilient strip or inflated tube engages a first end portion of each sensing finger to press the end portions of the sensing fingers up against the respective retaining flanges. The yarn sheet passes over the sensing fingers and, on both sides of the channel, is held down by guide bars which are lower than the sensing fingers. If tension on a yarn exceeds a predetermined value, such yarn presses the finger or fingers that it engages down to bring the second end portions into engagement with an electrical contact strip which constitutes a switch element in an electrical circuit comprising a signal light and a relay for stopping the associated yarn processing machine. In one embodiment, the contact strip is divided into sections which are insulated from one another and the electric circuit includes an LED connected with each section of the contact strip so as to indicate the approximate location of a tight end in the yarn sheet.

18 Claims, 6 Drawing Sheets

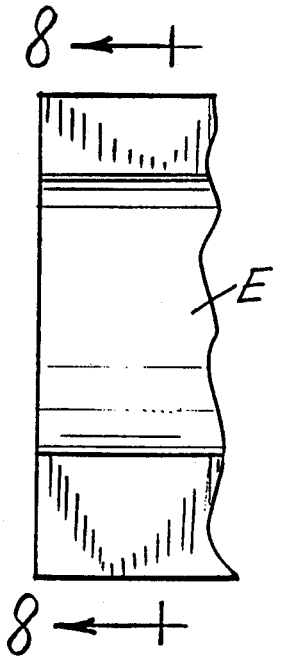
FIG. 7
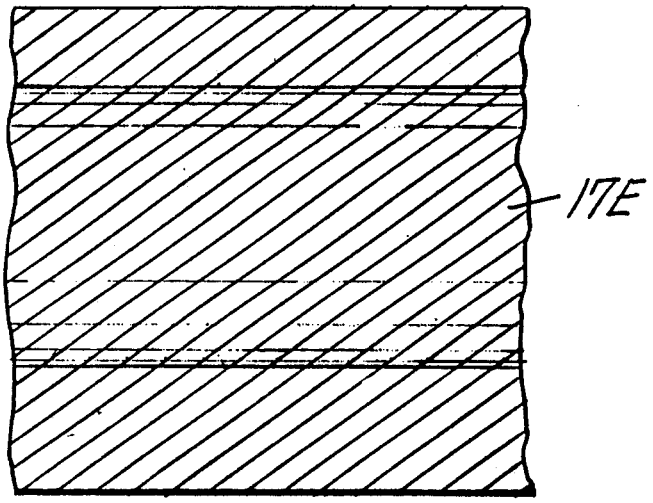
FIG. 7A
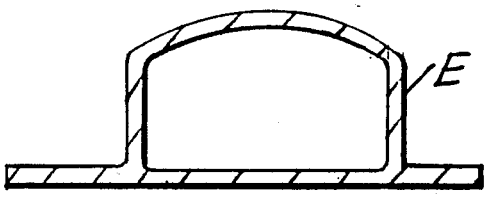
FIG. 8
FIG. 9
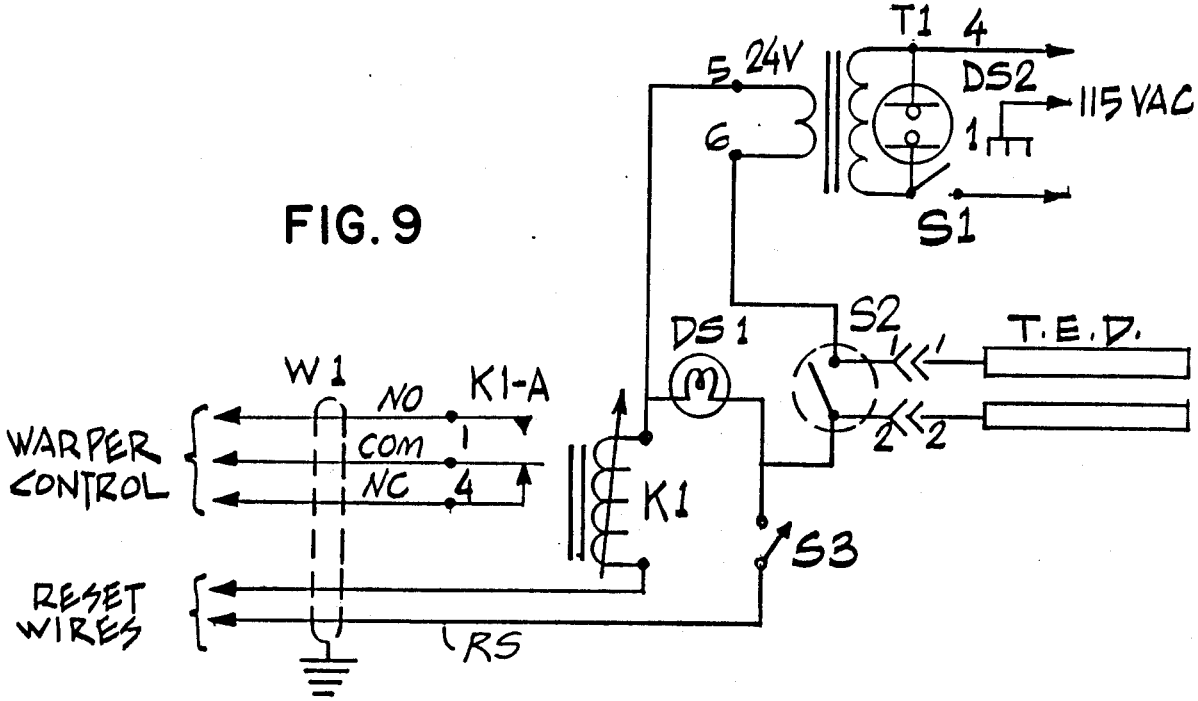

APPARATUS FOR DETECTING TIGHT ENDS IN A SHEET OF YARNS

REFERENCE TO PRECEDING APPLICATION

This is a Continuation-In-Part of application Ser. No. 292,546 filed Dec. 30, 1988, abandoned.

FIELD OF INVENTION:

The present invention relates to apparatus for use in association with a yarn processing machine, such as a warping machine, for detecting tight ends in a sheet of yarns.

BACKGROUND OF THE INVENTION:

In apparatus for processing a sheet of yarns disposed side by side, for example a warping machine, it sometimes happens that the tension on one or more ends of yarn becomes excessive. Unless this excessive tension is detected and corrected quickly, the elastic limit of the yarn may be reached with the result that the yarn breaks. Moreover, excessive tightness may cause a change in the molecular characteristics of the yarn material, causing problems in subsequent operations such as draw-warping dyeing, weaving and knitting. It is especially important that a tight end detecting device react very quickly, usually within a few milliseconds, so that it is able to produce a signal to stop the operation of the machine before breakage occurs.

There is known a tight end detector in which a sensing finger element traverses the width of the yarn sheet, "feeling" the tension of each end individually as it passes by. This method is usually too slow to detect tight ends before breakage occurs. Moreover, the device is very expensive.

OBJECT OF THE INVENTION:

It is an object of the present invention to provide apparatus which will detect tight ends in a sheet of yarns and will react quickly to provide a signal or stop an associated yarn processing machine. It is a further object of the invention to provide tight end detecting apparatus which is of simple construction and reliable in operation.

SUMMARY OF THE INVENTION:

In accordance with the invention, tight end detecting apparatus comprises an elongated channel which extends across a sheet of yarns and is open on a side facing the yarn sheet. In the channel there is provided a multiplicity of sensing elements which are resiliently supported and project outwardly of the open side of the channel so as to be engaged by the yarns. The yarn is guided over the channel in such manner as to form an obtuse angle over the sensing elements in the channel. When a tight end occurs the element or elements engaged by the tight end are depressed and actuate an electrical contact in a control circuit for producing a signal or for stopping associated yarn processing apparatus. In a second embodiment of the invention, means is provided for indicating the approximate location of the tight end or tight ends in the yarn sheet.

BRIEF DESCRIPTION OF DRAWINGS:

The apparatus in accordance with the invention will be more fully understood from the following description of a preferred embodiment illustrated by way of example in the accompanying drawings in which:

FIG. 7 is a top plan view of an extrusion from which sensing elements of a different construction are produced.

FIG. 7*a* is a top plan view illustrating how the extrusion of FIG. 7 is "sliced" to produce a multiplicity of sensing elements.

FIG. 8 is a cross sectional view of the extrusion of FIG. 7.

FIG. 9 is a circuit diagram of a control circuit of the apparatus.

Figure 1:
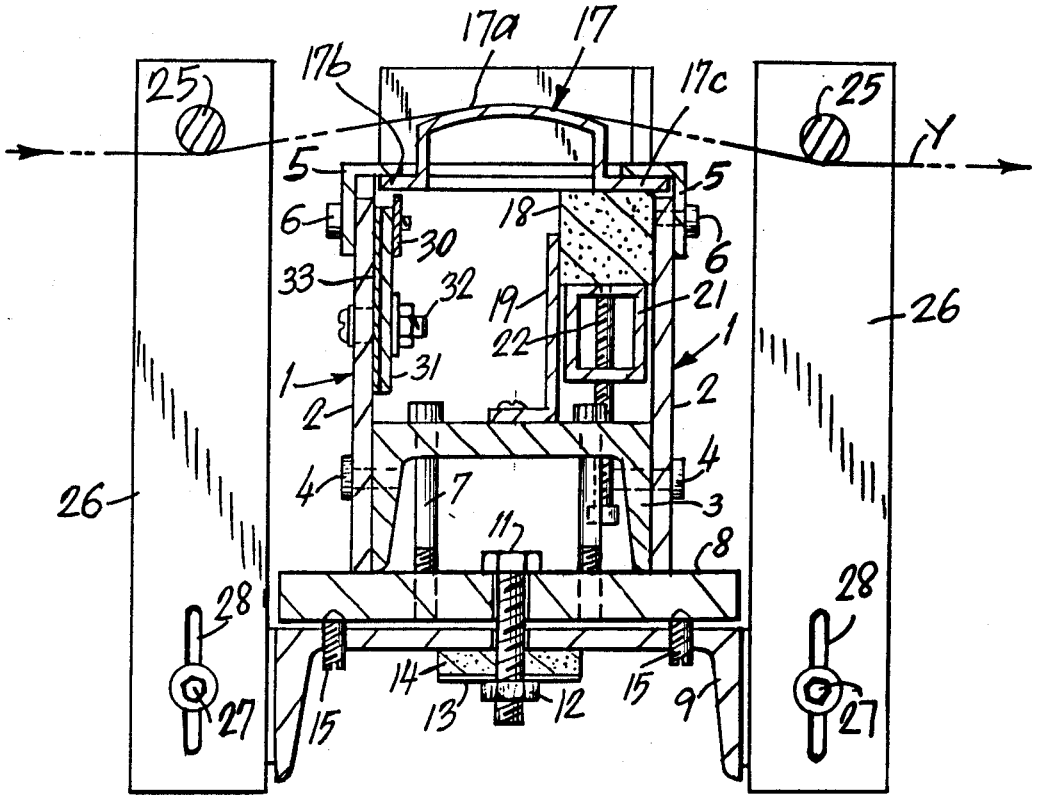
FIG. 1 is a vertical cross section of apparatus in accordance with the invention.

DESCRIPTION OF PREFERRED EMBODIMENT:

The embodiment of apparatus shown by way of example in the drawings comprises an elongate channel 1 which extends transversely of the sheet of yarns Y and comprises side plates 2 secured to a beam 3 by screws 4. At an open side which faces the yarn sheet, the channel 1 has inturned flanges 5 which are secured to the side plates 2 by screws 6 extending through slotted openings in the flanges to provide adjustment.

The beam 3 is secured by bolts 7 to two or more longitudinally spaced base plates 8 which in turn are secured to a beam 9 by bolts 11 each of which passes through a tapped hole in the base plate 8 and an aligned oversized hole in the beam 9 and is provided with a lock nut 12, washer 13 and resilient washer 14. Set screws 15 extend through threaded openings at opposite sides of the beam 9 and engage the lower side of the base plate. While both of the set screws are shown pointed, one may be flat and engage a flat surface of base plate 8. By means of the set screws 15, the position of the base plate 8 and hence of the channel 1 can be precisely levelled and adjusted, resilient movement of the base plate relative to the beam 9 being permitted by the resilient washers 14. This is required because the beam 9 is steel while the channel 1 and base plates 8 are aluminum. Differential expansion of these members requires freedom for relative movement without looseness.

At its open side, the channel 1 accommodates a multiplicity of sensing elements shown in the form of slender fingers 17 having outwardly bowed central portions 17*a* and projecting end portions 17*b* and 17*c*. As seen in FIG. 2, the fingers 17 are disposed side-by-side and are spaced as closely together as possible while still retaining freedom of relative vertical movement. The fingers extend generally transversely of the channel 1 but at an angle less than 90° to the length of the channel. The angle of the fingers 17 to the length of the channel is preferably between 35° and 65° and is desirable about 60°. The fingers are maintained at the desired angle by positioning members 20 at opposite ends of the channel 1. The end portions 17*b* and 17*c* of the fingers 17 are received inside the flanges 5 of the channel 1 and are resiliently pressed against the inner faces of the flanges by a resilient strip 18 which presses against the end portions 17*c* of the fingers. In the embodiment illustrated in FIG. 1, the resilient strip 18 comprises an elongate strip of cellular foam plastic which is retained between a guide bar 19 and a side plate 2 of the channel and is pressed against the end portions 17*c* of the fingers 17 by a pressure bar 21 which is supported on the beam 3 by longitudinally spaced screws 22 which provide precise positioning of the pressure bar 21 and hence of the pressure with which the resilient strip 18 presses against the end portion 17*c* of the fingers 17.

Figure 2:
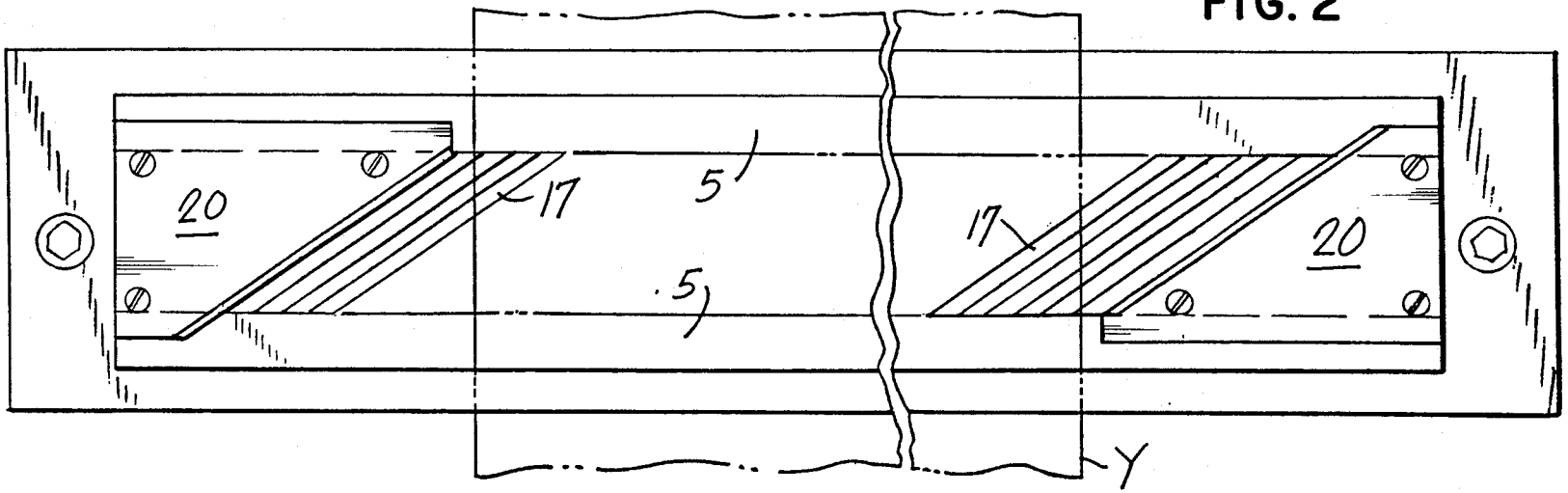
FIG. 2 is a top plan view of the apparatus.
Figure 3:
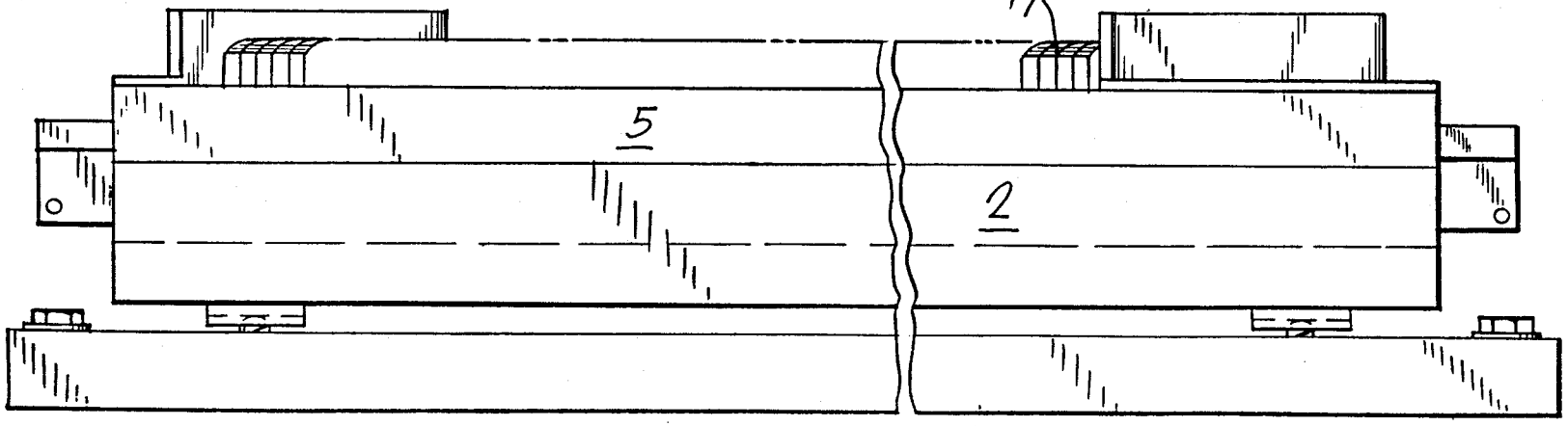
FIG. 3 is a side elevation of the apparatus.
Figure 4:
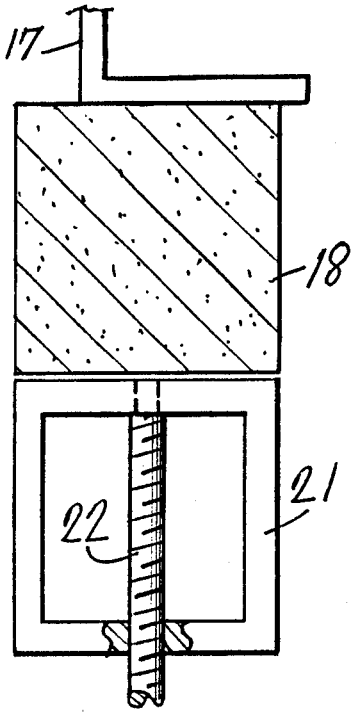
FIG. 4 is a detail cross section view showing means for applying resilient force to one of the sensing elements.

As seen in FIG. 1, outwardly bowed center portions 17*a* of the sensing fingers 17 are engaged by yarns of the yarn sheet Y. The central portions of the fingers are preferably abrasion resistant so as to resist abrasion by the yarns passing over them. Upstream and downstream of the channel 1, the yarn sheet is guided by hold-down bars 25 supported by supports 26 mounted on the beam 9 by brackets and bolts 27 which pass through elongate slots 28 in the supports 26 so that the supports 26 and hence the hold down bars 25 can be adjusted vertically. As seen in FIG. 1, the hold down bars 25 are positioned lower than the central portions 17*a* of the sensing fingers 17 so that the yarns form an obtuse angle in passing under the hold down bars 25 and over the sensing fingers 17. As the yarns are under a selected normal tension, they exert a downward pressure on the sensing fingers by reason of this angle. If the tension of a yarn increases above normal tension, such yarn will exert greater downward pressure on the finger or fingers which such yarn engages.

The pressure exerted by the resilient strip 18 on the sensing fingers 17 is such that when yarns are under normal tension, the sensing fingers 17 are held in the position shown in FIG. 1 with the free ends 17*b* in engagement with the inner face of the respective flange 5. However, if the tension of a yarn increases above normal tension, such yarn exerts greater downward force on the sensing finger or fingers which it engages and presses such finger or fingers downwardly to bring the free end 17*b* into contact with an electrical contact strip 30 mounted on a vertically adjustable contact strip holder 31 which in turn is mounted on the respective side plate 2 by bolts 32, while being insulated from the plate 2 by a sheet of insulation 33 and insulating bushings around the bolts 32. By vertical adjustment of the contact strip holder 31, permitted by elongate openings for the bolts 32, the vertical position of the contact strip 30 and hence the normal gap between the contact strip and the end portions 17*b* of the sensing fingers 17 can be precisely adjusted.

As the sensing fingers 17 are electrically conductive and as the ends 17*c* of the sensing fingers are in electrical contact with the respective flange 5 of the channel 1, the sensing fingers constitute an electrical switch of which one terminal is the channel 1 and the other terminal is the contact strip 30. Such switch is an element of a control circuit shown schematically in FIG. 9.

The circuit comprises a power supply T1 for supplying 24 volt AC current to the tight end detector circuit. Power can be turned on or off by a switch S1 and an indicator light DS2 indicates whether power is on or off. The switch composed of the sensing fingers is illustrated as a single pole single throw switch S2. The switch S2 controls an indicator light DS1 and a relay K1 which controls the warper or other apparatus with which the tight end detector is associated.

When a sensing finger is pressed into contact with the contact strip 30 by excessive tension on a yarn or yarns, the switch represented by switch S2 is closed, thereby supplying power to the indicator light DS1 and the relay K1. The indicator light DS1 is thereby illuminated. However, the relay K1 is a delay relay which is not actuated unless and until the switch S2 remains closed for a selected period of time. Hence, if only momentary pressure is applied to a sensing finger so that the switch S2 is closed only momentarily, the indicator light DS1 flashes but the relay K1 is not actuated to stop the warper or other apparatus. This avoids false stops. When the switch S2 remains closed for a predetermined period of time, i.e. when a sensing finger remains in contact with the contact strip 30, the relay K1 is actuated to stop the warper or other apparatus. After a tight end has been corrected the relay K1 can be reset by reset wires RS. A switch S3 is provided for disabling the relay K1. When the switch S3 is open, the occurrence of a tight end is indicated by the indicator light DS1 but the warper or other apparatus is not stopped.

Figure 5:
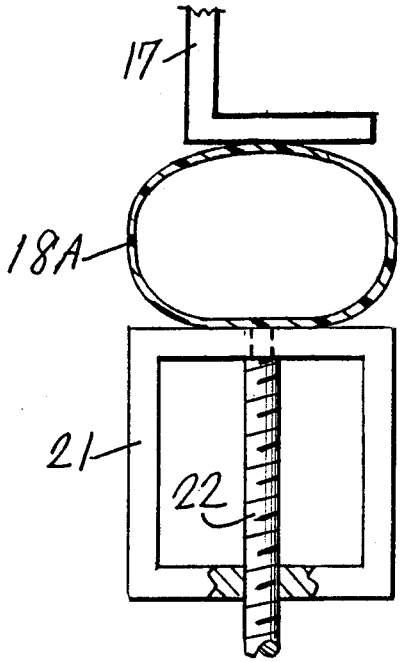
FIG. 5 is a detailed cross sectional view showing another embodiment of a resilient element.

While the resilient strip for holding the sensing finger 17 is shown in FIG. 1 as a strip 18 of cellular foam plastic, other resilient media can be used. Thus, as illustrated by way of example in FIG. 5, the elastic strip may be in the form of an inflated flexible tube 18A. The sensitivity of the sensing fingers, i.e. the pressure required to depress them, can be regulated by regulating the pressure to which the tube 18A is inflated.

Figure 6:
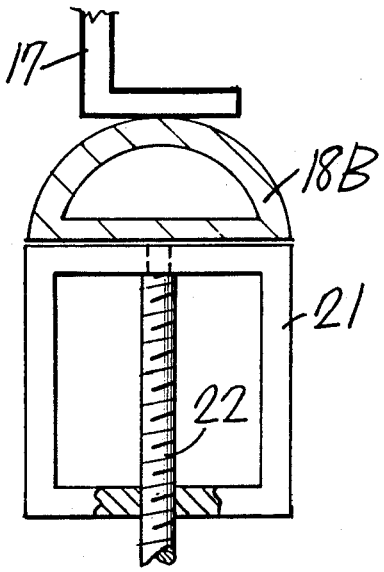
FIG. 6 is a detailed cross sectional view showing a further embodiment of a resilient element.

Another possibility is illustrated in FIG. 6 where the flexible strip is in the form of a hollow rubber or plastic extruded tube of selected cross section 18B for example, a D-shape cross section as shown.

In the embodiment illustrated in FIG. 1, the sensing fingers 17 are formed of wire bent to the desired shape. FIGS. 7, 7A and 8 illustrate another embodiment in which sensing fingers 17E are formed being sliced from an extrusion, for example an aluminum extrusion having the cross sectional shape shown in FIG. 8. As illustrated in FIG. 7A, the slicing is at an angle to the length of the extrusion so that the individual fingers, when assembled in the channel 1 of the apparatus, are disposed at a selected angle to the length of the channel.

Instead of using a single contact strip 30 extending the full length of the channel 1, the contact strip can desirably be divided into a plurality of sections insulated from one another but connected in parallel so that with reference to the circuit diagram shown in FIG. 9, there would in effect be a plurality of switches S2 all controlling the relay K1 but each having a respective indicator lamp DS1 so that each lamp corresponds to a respective section of the contact strip and thus to a corresponding portion of the width of the yarn sheet. This is of assistance to an operator in locating the portion of the yarn sheet in which a tight end occurs.

Figure 10:
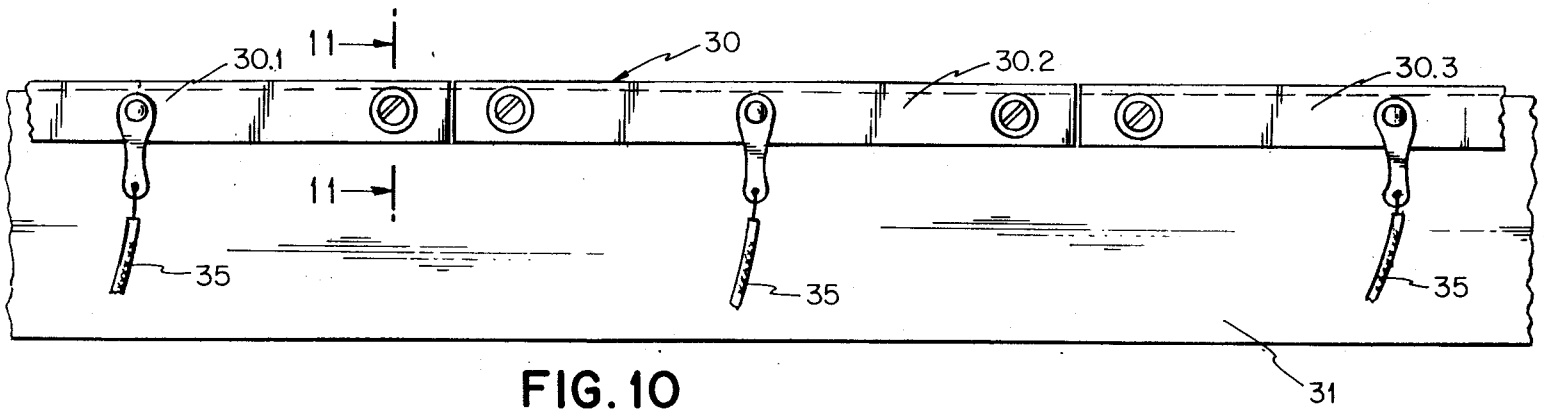
FIG. 10 is a schematic side elevation of a portion of a segmented contact strip of a second embodiment of the invention.
Figure 11:
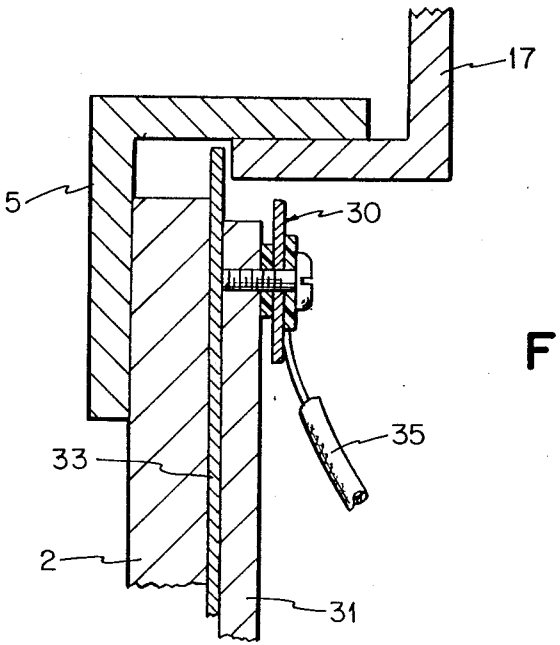
FIG. 11 is an enlarged cross section taken on the line 11—11 in FIG. 10.
Figure 12:
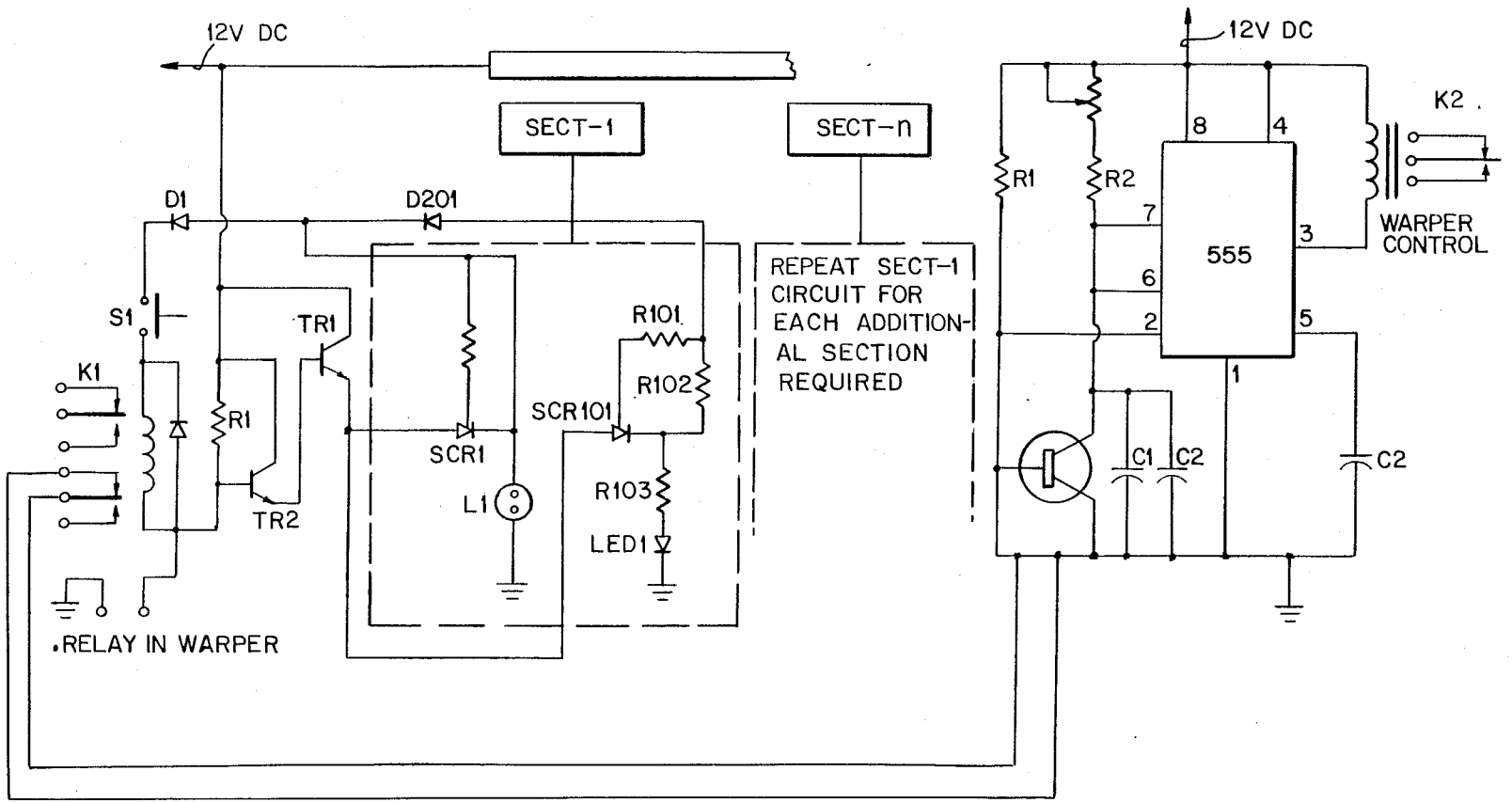
FIG. 12 is a circuit diagram of the control and indicating circuit of the second embodiment of the invention.

Such an arrangement is illustrated by way of example in FIGS. 10, 11 and 12. As seen in FIG. 10, the contact strip 30 is divided into a plurality of sections 30.1, 30.2, 30.3, etc. which are mounted on the contact strip holder 31 in such manner as to be insulated from one another. The sections may, for example, have a length of from four to twelve inches. An individual lead line 35 extends from each of the sections of the contact strip to the control and indicating circuit shown in FIG. 12.

The control and indicating circuit shown in FIG. 12 comprises a main relay K1, a main indicator light L1, a light emitting diode (LED) for each section of the contact strip 30 and a warper control relay K2. When a tight end occurs, the main indicator light L1 and the LED corresponding to the section of the contact strip on which contact is made by the tight end, are illuminated, thereby indicating the occurrence of a tight end and the location of the tight end in the yarn sheet. Also the contacts of the relay K1 open, whereupon capacitors C1 and C2 begin to charge to start the timing cycle of the integrated circuit 555. At the end of the timing cycle, relay K2 contacts open to stop the warper. When the tight end has been cleared, the main indicator lamp L1 and the respective LED will go out and the warper can again be started.

While the elongate channel 1 is shown below the yarn sheet, it will be understood that the apparatus could be reversed with the channel 1 disposed above the yarn sheet with the open side facing downwardly.

The invention claimed is:

1. Apparatus for detecting tight ends in a sheet of yarns of an associated yarn processing machine, said apparatus comprising, an elongate channel adapted to extend transversely below a sheet of yarns, said channel having an upper open side, a multiplicity of sensing elements received in said channel and extending above said upper open side of said channel for engagement by yarns of said yarn sheet, said sensing elements being movable between an upper position and a lower position, means for resiliently positioning said sensing elements in an upper position and permitting movement of individual sensing elements to a lower position by abnormally tight yarn ends, electrical contact means operable by movement of one or more of said sensing elements from said upper position to said lower position, and electrical circuit means including said contact means for performing a predetermined control or indicating function upon operation of said contact means.

2. Apparatus according to claim 1, in which said sensing elements comprise slender fingers disposed side-by-side and extending transversely of said channel, said fingers having end portions retained in said channel and upward curved intermediate portions extending up above said upper open side of said channel.

3. Apparatus according to claim 2, in which said fingers are disposed at an angle of 35° to 65° to the length of said channel and in which positioning means are provided at ends of said channel for maintaining said fingers at a selected angle.

4. Apparatus according to claim 2, in which said intermediate portions of said fingers are abrasion resistant.

5. Apparatus according to claim 2, in which end portions of said fingers are retained in said channel by inturned flanges on said channel and in which said resilient positioning means comprises means for resiliently pressing a first end of each said fingers against a respective one of said flanges.

6. Apparatus according to claim 5, in which said means for resiliently pressing said first end of each of said fingers comprises a strip of resilient material.

7. Apparatus according to claim 6, in which means is provided for varying the pressure exerted by said resilient strip against ends of said fingers.

8. Apparatus according to claim 6, in which said resilient strip is made of foam plastic.

9. Apparatus according to claim 6, in which said resilient strip is an inflated tube with flexible walls.

10. Apparatus according to claim 6, in which said resilient strip is a tube of D-cross section.

11. Apparatus according to claim 5, in which said electrical contact means comprises a conductive contact strip engageable by a second end of each of said fingers when moved from said upper position to said lower position.

12. Apparatus according to claim 11, in which means is provided for varying the vertical position of said contact strip and for securing it in selected position.

13. Apparatus according to claim 1, in which hold-down bars positioned upstream and downstream of said channel define planes in which said yarn sheet is presented to said sensing elements.

14. Apparatus according to claim 1, in which said circuit means includes delay means for inhibiting said control function when said electrical contact means is operated for a period of time less than a predetermined period.

15. Apparatus for detecting tight ends in a sheet of yarns of an associated yarn processing machine, said apparatus comprising, an elongate channel extending transversely of said sheet of yarns and having an open side facing said sheet of yarns, a multiplicity of sensing elements received in said channel and projecting outwardly of said open side of said channel for engagement by yarns of said sheet of yarns, means resiliently holding said sensing elements in outward position, means guiding said sheet of yarns to present said yarns to said channel in an obtuse angle with said sensing elements at the apex of said angle so that excess tension on any yarn acts to depress the sensing element or elements engaged by said yarn against the force of said resilient means, and electric circuit means including means for detecting the depression of any sensing element or elements and control or signal means actuated by said detecting means.

16. Apparatus for detecting tight ends in a sheet of yarns of an associated yarn processing machine, said apparatus comprising an elongate support extending transversely of said sheet of yarns, a multiplicity of tension sensing elements on said support in position for engagement by yarns of said sheet, said sensing elements being individually responsive to tension of said yarns for actuation by excessive tension, electric circuit means connected with said sensing elements and including means for indicating the actuation of any of said sensing elements and the location on said support of any sensing element that is actuated.

17. Apparatus according to claim 16, in which said circuit means comprises a contact strip extending parallel to said support and divided into sections electrically insulated from one another and individual indicating means connected respectively with said sections, and in which said sensing elements include means for making electrical contact with respective sections of said contact strip when actuated by excessive tension of yarn engaging said sensing elements.

18. Apparatus according to claim 16, in which said circuit means includes means for stopping the operation of said associated yarn processing machine a selected period of time after detection of a tight end by said sensing elements.

* * * * *